US005316402A

United States Patent [19]

Wakai et al.

[11] Patent Number: 5,316,402

[45] Date of Patent: May 31, 1994

[54] PENHOLDER CAP

[75] Inventors: Takeshi Wakai; Masahiko Nagai, both of Tokyo, Japan

[73] Assignee: Tombow Pencil Co., Ltd., Tokyo, Japan

[21] Appl. No.: 5,919

[22] Filed: Jan. 19, 1993

Related U.S. Application Data

[63] Continuation of Ser. No. 806,557, Dec. 13, 1991, abandoned.

[51] Int. Cl.[5] ..... B43K 9/00

[52] U.S. Cl. ..... 401/202; 401/213; 401/243

[58] Field of Search ..... 401/202, 213, 243, 247

[56] References Cited

U.S. PATENT DOCUMENTS 5,000,603 3/1991 Isoda .
5,000,604 3/1991 Isoda .

FOREIGN PATENT DOCUMENTS 2641735 7/1990 France .
2174374 A 11/1986 Great Britain .
0204252 12/1986 European Pat. Off. .
0319311 6/1989 European Pat. Off. .
0330877 9/1989 European Pat. Off. .
2218381 11/1989 Great Britain .
0433532 3/1990 European Pat. Off. .
0394609 10/1990 European Pat. Off. .
0395797 11/1990 European Pat. Off. .
0400272 12/1990 European Pat. Off. .
3728896 6/1988 Fed. Rep. of Germany .
8901313 2/1989 Fed. Rep. of Germany .
8908065.3 10/1989 Fed. Rep. of Germany .
3817248C1 12/1989 Fed. Rep. of Germany .
3818473A1 12/1989 Fed. Rep. of Germany .
3821195A1 12/1989 Fed. Rep. of Germany .
8903755 3/1990 Fed. Rep. of Germany .
8803209 4/1990 Fed. Rep. of Germany .
2229967 10/1990 Great Britain .
8908928 4/1990 Fed. Rep. of Germany .
2224244 A 5/1990 Great Britain .
3839249A1 5/1990 Fed. Rep. of Germany .
9000991 6/1990 Fed. Rep. of Germany .
8907626 7/1990 Fed. Rep. of Germany .
3903415A1 8/1990 Fed. Rep. of Germany .
3921730A1 1/1991 Fed. Rep. of Germany .
3921780A1 1/1991 Fed. Rep. of Germany .
8904762 1/1991 Fed. Rep. of Germany .
3931983 4/1991 Fed. Rep. of Germany .
2236509 4/1991 Great Britain .
3934006 4/1991 Fed. Rep. of Germany .
3934481A1 4/1991 Fed. Rep. of Germany .
3934482A1 4/1991 Fed. Rep. of Germany .
2233607A 1/1991 Great Britain .
2233608A 1/1991 Great Britain .
2233609A 1/1991 Great Britain .
13506 of 0000 Japan .
51-73139 6/1976 Japan .
52-118038 9/1977 Japan .
61-11016 4/1986 Japan .
61-270196 11/1986 Japan .
1-106280 7/1989 Japan .
1-106283 7/1989 Japan .
1-139593 9/1989 Japan .
1-139595 9/1989 Japan .
1-169384 11/1989 Japan .
1-169385 11/1989 Japan .
1-169386 11/1989 Japan .
2-3885 1/1990 Japan .
2-5991 2/1990 Japan .
2-22887 2/1990 Japan .
2-58981 4/1990 Japan .
3-9878 1/1991 Japan .
3-9879 1/1991 Japan .
3-9880 1/1991 Japan .
3-15190 2/1991 Japan .
3-57087 5/1991 Japan .

*Primary Examiner*—Steven A. Bratlie
*Attorney, Agent, or Firm*—Townsend and Townsend Khourie and Crew

[57] ABSTRACT

To provide an air passage, exteriorly to a swallowed pen cap, a penholder cap is formed in one body. A groove is placed side by side to the direction of cap axis from closed end edge of a cap body toward the other open end. On the end of the groove, at least one rib is disposed. This rib has an end extended on the groove up to the open edge of the cap. This rib is projected from the surface of a cap body and a connection supporting part which holds a rib is provided away from the outside surface of the tightening part.

1 Claim, 3 Drawing Sheets

PENHOLDER CAP

This is a continuation of application Ser. No. 07/806,557, filed Dec. 13, 1991, now abandoned.

The device refers to the cap for a penholder avoiding suffocation in case the cap is accidentally swallowed.

BACKGROUND OF THE INVENTION

So far, there has been a type of the cap for a penholder, preventing evaporation of ink at the pointed end of a pen being substantially air-tight. To secure ventilation to the direction of axis in case the cap is accidentally swallowed, it sets the inner cylindrical body in the outer cylindrical body and secures ventilation to the direction of axis through the space between inner and outer cylindrical body and also it covers and makes substantially air-tight a pointed end of a writing instrument by the inner cylindrical body (Japanese utility model open number 1-139595, Japanese utility model open number 1-1693 85).

There has also been a cap providing a vertical groove placed side by side on the outside circumference which is connected to the inside of the cap thus securing ventilation to the direction of axis through the groove in case the cap, is accidentally swallowed.

However, the formation of a number of above-said prior art caps specially in one body with inner and outer cylindrical body separated would complicate the production process, and composition parts would increases in number, and consequently it cost a great deal even if safety is maintained. Providing the air passage on outside circumference to the direction of axis from the closed end edge through inside the cap body up to the open end edge causes restriction to the use of a cap for the reason of production and design. Moreover, the rib provided on the circumference causes incomplete formation of the substantially air-tight area inside the cap through the process of formation thus it would be defective in providing air tightness.

Some defects of the prior art caps are improved by this device. It is formed in one body, is easy to form, lowers the cost, and improves a substantially air-tight condition while preventing suffocation in case the cap is swallowed.

SUMMARY OF THE INVENTION

To provide an air passage about a swallowed cap, a penholder cap is formed in one body. A groove is placed side by side to the direction of cap axis from the closed end edge of a cap body toward the other open end. On the end of above-said groove, at least one rib is disposed. This rib has an end extended on the groove up to the open edge of the cap. This rib is projected from the surface of a cap body and a connection supporting part which holds a rib is provided away from the outside surface of the tightening part.

The above-said composition of the cap allows to form the cap in one body easily using a metallic mold by drawn mold method. Even if the cap is accidentally swallowed, the air passage is provided to the direction of axis on all occasions, since a groove is provided on the cap and one end of at least one of the projected ribs is extended on a groove up to the open end edge, thus avoid suffocation by the cap. By providing a connecting supporting part away the outside surface of the substantially air-tight cap, the substantially air-tight cap would not be affected by incomplete function caused by ribs through formation of the cap, thus the substantially air-tight condition would work perfectly.

BRIEF DESCRIPTION OF THE DRAWINGS

FIGS. 1 to 4 are on the first working illustrations of the device in which FIG. 1 shows a front view, FIG. 2 a section view of an end part, FIG. 3 an end view of the closed end of the cap and FIG. 4 a cross section view of FIG. I A—A.

FIGS. 5 to 7 are on the second working illustrations, which FIG. 5 shows a front view and FIGS. 6 and 7 show section views of both cap ends;

DESCRIPTION OF THE PREFERRED EMBODIMENT

Figure 1:
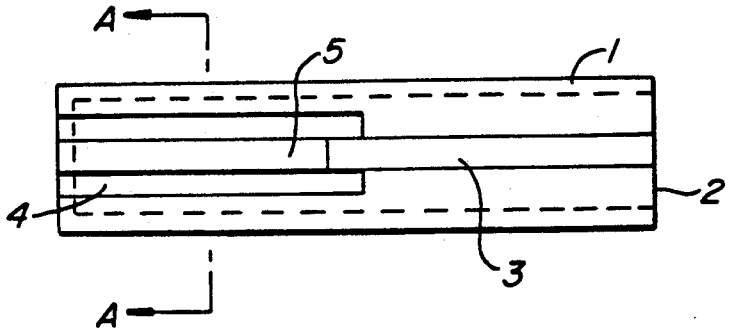
Figure 2:
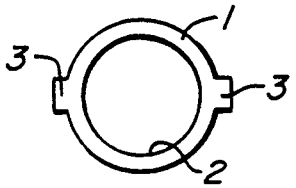
Figure 3:
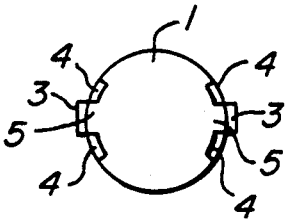
Figure 4:
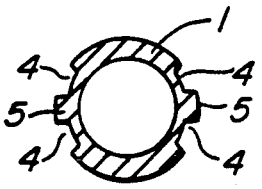
Figure 10:
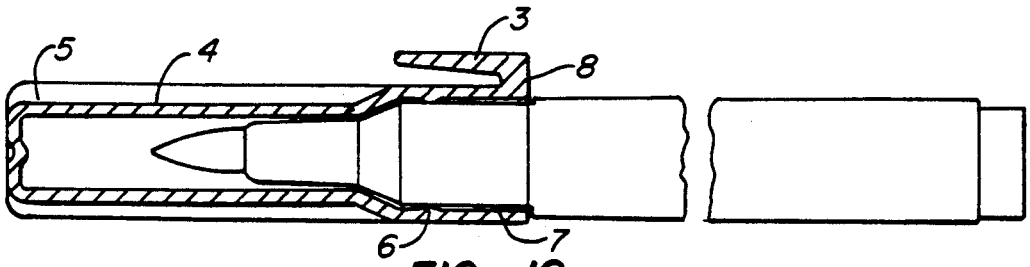
Figure 11:
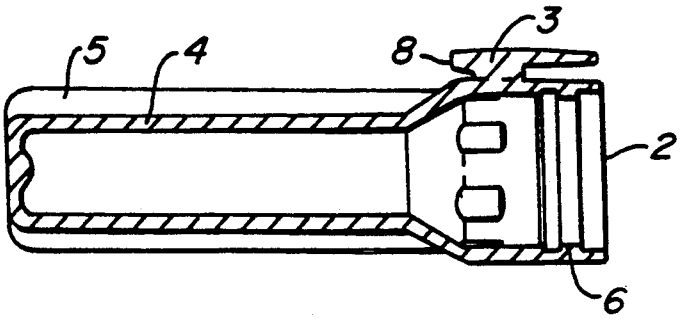

Referring generally to FIG. 1, cap body 1 is shown with open end 2. Exterior of cap body rib 3 is illustrated with groove 4. As mounted to a pen (see FIG. 10), the cap includes tightening part 6 with connection supporting part 8.

The invention is now being further described with working illustration shown in the drawings. The same mark shown in each drawings indicate the same component parts. FIGS. 1 to 4 show the first working illustration. (1) is a cap body. Its one end is an open end (2) and the other end is a closed end. A top part of penholder (see FIG. 10) is inserted from the open end (2) and the cap body covers and air-tightens the pointed end of a pen. (3) is a rib projecting from outside circumference of a cap body (1) extending to the open end (2) against the cap body to the direction of axis. One end of the rib (3) opposite to the open end is extended on a groove (4) from the end of a groove (4) which is provided from the closed end edge of above-said cap body (1) up to nearly its center. (5) is the surface of a cap body through a groove (4).

Since the first working illustration is constructed as mentioned above, it is easily formed in one body and its metallic mold is made simple. In case the cap is accidentally swallowed, the air passage through the direction of axis with necessary section is secured by a groove and the rib (3) extended from the end of a groove (4) and projected from the surface of a cap body (1).

Figure 5:
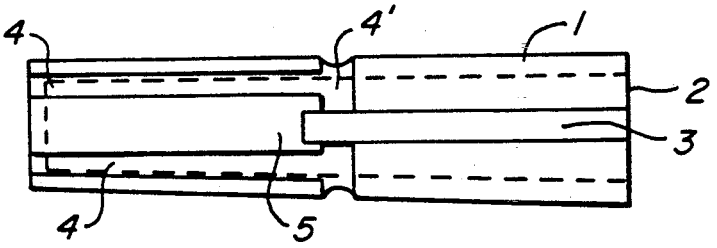
Figure 6:
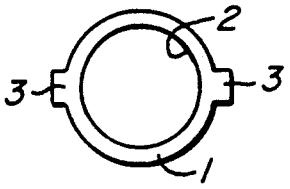
Figure 7:
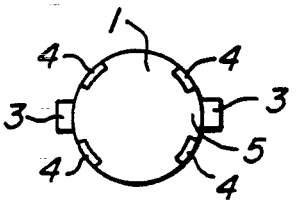

FIG. 5 to 7 show the second working illustration. The end of a groove (4) mentioned in the first illustration is connected to the circular groove (4'). Other constructions are the same as that of the first working illustration.

Since a circular groove (4,) is provided to the second working illustration, the air from the groove (4) flows to the surface of the cap body (1) through the circular groove (4') even if one of the other grooves (4) is closed, and the air passage through the space provided around a rib (3) to the direction of axis is secured.

Figure 12:
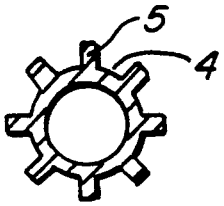
Figure 13:
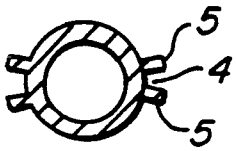

FIG. 8 to 13 show the third working illustration. It is formed in one body with a narrow and rib-like partition wall (5) provided on a comparatively long groove (4), and an end of a rib (3), which is extended on the groove (4) and projected from a cap body (1), is extended nearly to the open end (2). FIG. 12 and 13 are a cross section view showing the transformation of a groove (4) and a partition wall (5).

Figure 8:
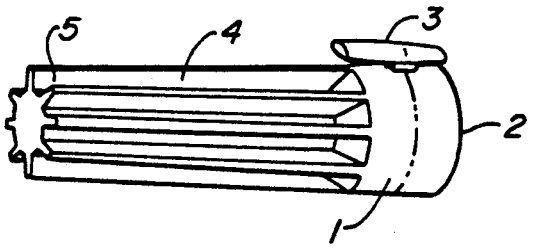
FIGS. 8 to 13 are illustrations of the third working illustration with FIG. 8 being an oblique view, FIG. 9 being a vertical section view, FIG. 10 being a vertical cross section view of the cap on a pen, FIG. 11 being an alternate embodiment similar to FIG. 9, and FIGS. 12 and 13 illustrating Various groove and rib configurations for the third working illustration.
Figure 9:
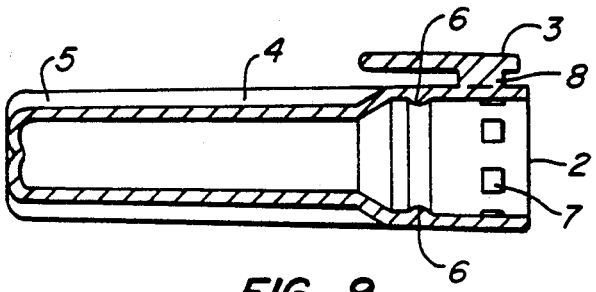

Since this working illustration is constructed as mentioned above, a cap is easily formed by drawing out the metallic mold to right and left at the dotted line (metallic parting) of FIG. 8, and the metallic mold can be a simple composition. Moreover, the rib (3) is provided to the cap body as to provide a connection supporting part (8) away from the outside surface of the tightening part (6) creating an air tight condition, sometimes referred to herein as 'air-tightening', thus the tightening part (6) would not be by the defect caused by incomplete formation of ribs (3) through formation of the cap, and the air-tightening function at the pointed end of the pen would work perfectly. This construction allows to avoid the suffocation caused by swallowing the cap accidentally.

As mentioned above, the device makes the formation in one body easy, avoids the defect at the substantially air-tight cap part caused by incomplete formation, lowers the cost, enables to make a plan on the length of a groove and a rib relatively and thus allows a plan with wide possibilities, and it effectively prevents the suffocation which may be caused by swallowing the cap accidentally.

What is claimed is:

1. In the combination of a pen and a cap for covering said pen, the improvement to said cap for covering said pen comprising in combination:

a cap body being essentially cylindrical about an axis, said cap body having a first closed end, a second open end, and a defined receiving volume for fitting over and covering said pen when said pen is inserted to said open end along said axis of said pen cap;

an exterior circumferential groove disposed midway between said first closed end and said second open end, said circumferential groove configured on the exterior of said cap and defining a recessed surface entirely around said cap from the regular body of said cap;

four longitudinally extending grooves on the exterior of said pen cap, said grooves extending parallel to said cap axis and being configured on the exterior of said cap and defining recessed surfaces along said cap parallel to the axis of said cap, said recessed surfaces extending from the regular body of said cap at substantially equal radial intervals, said grooves commencing in the exterior surface of said cap from said closed end to said exterior circumferential groove whereby said exterior circumferential groove and said four longitudinal grooves are all in communication with one another along the exterior of said cap; and, first and second longitudinal ribs configured on opposite sides of said pen cap on the outside thereof, said ribs extending across said exterior circumferential groove at one end and extending to said cap at said open end, said first and second longitudinal ribs extending axially of said pen cap at radial locations offset from and between pairs of said longitudinally extending grooves whereby said four longitudinally extending grooves, said first and second longitudinal ribs and said exterior circumferential groove define interconnecting irregular surfaces for permitting air passage in the event that said pen cap is swallowed.

* * * * *